US005110312A

United States Patent [19]

Higby

[11] Patent Number: 5,110,312

[45] Date of Patent: May 5, 1992

[54] RELEASABLE ROLLER CLUTCH REVERSING TRANSMISSION

[75] Inventor: Jeffrey P. Higby, Wildwood, Ill.

[73] Assignee: Outboard Marine Corporation, Waukegan, Ill.

[21] Appl. No.: 523,045

[22] Filed: May 14, 1990

[51] Int. Cl.[5] ..... B63H 21/28

[52] U.S. Cl. ..... 440/75; 74/378; 440/900

[58] Field of Search ..... 440/75, 78, 900, 83; 74/371, 372, 378; 192/38, 44, 45

[56] References Cited

U.S. PATENT DOCUMENTS

| | | | |
|---|---|---|---|
| 1,076,030 | 10/1913 | Ford | 192/72 |
| 2,291,151 | 7/1942 | Dunn | 192/38 |
| 2,497,361 | 2/1950 | Kesteron | 192/44 |
| 3,269,497 | 8/1966 | Bergstedt | 192/51 |
| 3,481,436 | 12/1969 | Wilkowski | 192/35 |
| 3,854,560 | 12/1974 | Nishikawa et al. | 192/27 |
| 3,882,814 | 5/1975 | Shimanckas | 115/34 R |
| 3,919,964 | 11/1975 | Hagen | 115/34 R |
| 4,789,366 | 12/1988 | Hale | 440/75 |
| 4,850,910 | 7/1989 | Higby et al. | 440/75 |
| 4,865,570 | 9/1989 | Higby et al. | 440/86 |

*Primary Examiner*—Edwin L. Swinehart
*Attorney, Agent, or Firm*—Michael, Best & Friedrich

[57] ABSTRACT

Disclosed herein is a marine propulsion device including a propulsion unit comprising a gearcase including therein a cavity, a propeller shaft extending in the cavity and including a portion having an outer surface with an axially extending flat, and a forwardly open axial bore, a bevel gear rotatably supported in the gearcase for rotation relative to the propeller shaft and including a central bore receiving the portion of the propeller shaft in spaced relation thereto, a drive pinion supported for rotation by the propulsion unit and drivingly engaging the bevel gear, a shift shaft located in the axial bore in the propeller shaft for axial movement relative to the propeller shaft and between a drive position and a neutral position, a roller retained between the flat and the bevel gear and movable between a driving position in driving engagement between the bevel gear and the propeller shaft and a non-driving position free of driving engagement between the bevel gear and the propeller shaft, and a pair of members movable radially through the propeller shaft and operably connecting the shift shaft and the roller for displacing the roller to the driving position in response to movement of the shift shaft to the drive position and for displacing the roller to the non-driving position in response to movement of the shift shaft to the neutral position.

12 Claims, 2 Drawing Sheets

RELEASABLE ROLLER CLUTCH REVERSING TRANSMISSION

BACKGROUND OF THE INVENTION

1. Field of the Invention

The invention relates generally to marine propulsion devices, such as outboard motors and stern drive units. More particularly, the invention relates to reversing transmissions for such marine propulsion devices and to arrangements for transmitting axial propeller shaft thrust to the marine propulsion device gearcase.

2. Reference to Prior Art

Prior reversing transmissions for marine propulsion devices are generally of four different types:

1. The clutch dog type.
2. The cone clutch type.
3. The ball clutch type actuated by a radially movable member.
4. The roller bearing type actuated by a member movable axially on the outer surface of the propeller shaft.

The dog clutch type of reversing transmission is probably the most widely used and includes a clutch dog or member which is splined to the outer surface of a propeller shaft for axial movement relative thereto between positions of meshing engagement between two axially spaced counter rotating bevel gears. The clutch dog or member is moved axially by means of a pin connection with a shifter shaft housed in a forwardly open axial bore in the propeller shaft. The clutch dog or member and the bevel gears have essentially square projections, called lugs, which engage with each other when the clutch member or dog is moved axially toward one of the bevel gears. Examples of such constructions are shown in U.S. Pat. Nos. 4,850,910 and 4,865,570. Another embodiment of the dog clutch type moves the clutch dog axially by means of an external craddle on the clutch dog, rather than by the pin and internal shifter shaft. Dog clutches are very susceptible to wear.

The cone type clutch is used primarily in stern drive units. In this type of reversing transmission, two mating cones are forced together with a force proportional to the driving torque. This clutch relies entirely on the friction between the cones to drivingly connect the bevel gears to the propeller shaft. One example of such a cone type clutch is shown in U.S. Pat. No. 3,269,497.

The ball type clutch employes a shifter shaft which radially outwardly displaces one or more balls from recesses in the propeller shaft and into engagement with associated cam surfaces in the inside diameter of an associated bevel gear. Torque is transmitted directly from the engaged bevel gear to the propeller shaft through the balls. One example of such a ball type clutch is disclosed in U.S. Pat. No. 4,789,366. The ball type clutch is susceptible to impact damage to the balls and other components. Accordingly, its principal usage is in relatively low torque applications.

A roller type clutch is disclosed in U.S. Pat. No. 3,882,814 and involves axial movement of a roller retainer between forward drive, neutral, and rearward drive positions.

Attention is directed to the following prior art United States Patents:

| | | |
|---|---|---|
| 1,076,030 | E. A. Ford | October 21, 1913 |
| 2,291,151 | W. T. Dunn | July 28, 1942 |
| 2,497,361 | H. M. Kesterton | February 14, 1950 |
| 3,269,497 | K. A. Bergstedt | August 30, 1966 |
| 3,481,436 | E. A. Wilkowski | December 2, 1969 |
| 3,854,560 | Nishikawa, et al. | December 17, 1974 |
| 3,882,814 | W. J. Shimanckas | May 13, 1975 |
| 3,919,964 | M. W. Hagen | November 18, 1975 |
| 4,789,366 | G. B Hale | December 6, 1988 |
| 4,850,910 | Higby, et al. | July 25, 1989 |
| 4,865,570 | Higby, et al. | September 12, 1989 |

SUMMARY OF THE INVENTION

The invention provides a marine propulsion device including a propulsion unit comprising a gearcase including therein a cavity, a propeller shaft extending in the cavity and including a portion having an outer surface with an axially extending flat, and a forwardly open axial bore, a bevel gear rotatably supported in the gearcase for rotation relative to the propeller shaft and including a central bore receiving the portion of the propeller shaft in spaced relation thereto, a drive pinion supported for rotation by the propulsion unit and drivingly engaging the bevel gear, a shift shaft located in the axial bore in the propeller shaft for axial movement relative to the propeller shaft and between a drive position and a neutral position, a roller retained between the flat and the bevel gear and movable between a driving position in driving engagement between the bevel gear and the propeller shaft and a non-driving position free of driving engagement between the bevel gear and the propeller shaft, and means operably connecting the shift shaft and the roller for displacing the roller to the driving position in response to movement of the shift shaft to the drive position and for displacing the roller to the non-driving position in response to movement of the shift shaft to the neutral position and including a radially movable member.

The invention also provides a marine propulsion device including a propulsion unit comprising a gearcase including therein a cavity, a propeller shaft extending in the cavity and including a forwardly open axial bore, and a portion having an outer surface with an axially extending flat, a first radially extending hole communicating with the bore and with the outer surface of the forward portion, a second radially extending hole communicating with the bore and with the outer surface of the forward portion and located in spaced relation to the first hole, a bevel gear rotatably supported in the gearcase for rotation relative to the propeller shaft and including a central bore receiving the propeller shaft portion in spaced relation thereto, a drive pinion supported for rotation by the propulsion unit and drivingly engaging the bevel gear, a cage located intermediate the bevel gear and the portion of the propeller shaft and rotatable relative to the propeller shaft between a drive position and a neutral portion, a roller retained by the cage for common movement therewith and located between the bevel gear and the flat on the portion of the propeller shaft for driving engagement therebetween when the cage is in the drive position and for non-driving relation thereto when the cage is in the neutral position, a first member located in the first hole for radial movement relative to the propeller shaft, a second member located in the second hole for radial movement relative to the propeller shaft, a shift shaft located in the axial bore in the propeller shaft for axial movement relative to the propeller shaft and between a neutral position and a drive position, means on the shift shaft and on the first member for moving first member radially outwardly in response to axial movement of the shift shaft to the neutral position, means on the first member and on the cage for rotating the cage relative to the propeller shaft in a first rotary direction in response to radial outward movement of the first member, means on the shift shaft and on the second member for moving the second member radially outwardly in response to movement of the shift shaft to the drive position, means on the second member and on the cage for rotating the cage relative to the propeller shaft in a second rotary direction opposite to the first rotary direction in response to radially outward movement of the second member, and means connected to the shift shaft for axially displacing the shift shaft between the neutral position and the drive position in response to activity of an operator.

The invention also provides a marine propulsion device including a propulsion unit comprising a gearcase including therein a cavity, a propeller shaft extending in the cavity and including a forward portion having an outer surface with an axially extending flat, a rearward portion having an outer surface with a rearwardly extending flat, and a forwardly open axial bore, a forwardly located bevel gear rotatably supported in the gearcase for rotation relative to the propeller shaft and including a central bore receiving the forward portion of the propeller shaft in spaced relation thereto, a rearwardly located bevel gear rotatably supported in the gearcase for rotation relative to the propeller shaft, located in axially spaced and facing relation to the forwardly located bevel gear and including a central bore receiving the rearward portion of the propeller shaft in spaced relation thereto, a drive pinion supported for rotation by the propulsion unit and drivingly engaging both the first and second bevel gears, whereby the first and second bevel gears counter-rotate, a shift shaft located in the axial bore in the propeller shaft and movable axially therein relative to the propeller shaft and between a first drive position, a neutral position, and a second drive position, a forward roller retained between the flat on the forward portion of the propeller shaft and the forwardly located bevel gear and movable between a driving position in driving engagement between the forwardly located bevel gear and the forward portion of the propeller shaft and a non-driving position free of driving engagement between the forwardly located bevel gear and the forward portion of the propeller shaft, a rearward roller retained between the flat on the rearward portion of the propeller shaft and the rearwardly located bevel gear and movable between a driving position in driving engagement between the rearwardly located bevel gear and the rearward portion of the propeller shaft and a non-driving position free of driving engagement between the rearwardly located bevel gear and the rearward portion of the propeller shaft, means operably connecting the shift shaft and the forward and rearward rollers and including a radially movable member for locating the forward roller and the rearward roller in the non-driving positions in response to movement of the shift shaft to the neutral position, for locating the forward roller in the driving position in response to movement of the shift shaft to the first drive position while retaining the rearward roller in the non-driving position, and for displacing said rearward roller to the driving position in response to movement of the shift shaft to the second drive position while retaining the forward roller in the non-driving position.

The invention also provides a marine propulsion device including a propulsion unit comprising a gearcase including therein a cavity, a propeller shaft extending in the cavity and including a forward portion having an outer surface with a first diameter and with an axially extending flat, a central portion having a second diameter greater than the first diameter, a forwardly facing radial wall extending between the forward portion and the central portion, a rearward portion having an outer surface with a third diameter less than the second diameter and with an axially extending flat, a rearwardly facing radial wall extending between the central portion and the rearward portion, a forwardly open axial bore, a first radially extending hole communicating with the bore and with the outer surface of the forward portion, a second radially extending hole communicating with the bore and with the outer surface of the forward portion and located in spaced relation to the first hole, a third radially extending hole communicating with the bore and with the outer surface of the rearward portion and located in spaced relation to the first and second holes, a fourth radially extending hole communicating with the bore and with the outer surface of the rearward portion and located in spaced relation to the first, second, and third holes, a forwardly located bevel gear rotatably supported in the gearcase for rotation relative to the propeller shaft and including a central bore receiving the propeller shaft in spaced relation thereto, a forwardly facing radial wall, and a rearwardly facing radial wall extending from the central bore, a rearwardly located bevel gear rotatably supported in the gearcase for rotation relative to the propeller shaft, located in axially spaced and facing relation to the forwardly located bevel gear and including a central bore receiving the propeller shaft in spaced relation thereto, a rearwardly facing radial wall, and a forwardly facing radial wall extending from the central bore, a drive pinion supported for rotation by the propulsion unit and drivingly engaging both the first and second bevel gears, whereby the first and second bevel gears counter-rotate, a forward cage located intermediate the forwardly located bevel gear and the forward portion of the propeller shaft and rotatable relative to the propeller shaft between a drive position and a neutral portion, a forward roller retained by the forward cage for common movement therewith and located between the forwardly located bevel gear and the flat on the forward portion of the propeller shaft for driving engagement therebetween when the forward cage is in the drive position and for non-driving relation thereto when the forward cage is in the neutral position, a rearward cage located intermediate the rearward bevel gear and the rearward portion of the propeller shaft and rotatable relative to the propeller shaft between a drive position and a neutral position, a rearward roller retained by the rearward cage for common movement therewith and located between the rearwardly located bevel gear and the flat on the rearward portion of the propeller shaft for driving engagement therebetween when the rearward cage is in the drive position and for non-driving relation thereto when the rearward cage is in the neutral position, a first member located in the first hole for radial movement relative to the propeller shaft, a second member located in the second hole for radial movement relative to the propeller shaft, a third member located in the third hole for radial movement relative to the propeller shaft, a fourth member located in the fourth hole for radial movement relative to the propeller shaft, a shift shaft located in the axial bore in the propeller shaft for axial movement relative to the propeller shaft and between a first drive position, a neutral position, and a second drive position, means on the shift shaft and on the first member for moving the first member radially outwardly in response to axial movement of the shift shaft to the neutral position, means on the first member and on the forward cage for rotating the forward cage relative to the propeller shaft in a first rotary direction in response to radial outward movement of the first member, means on the shift shaft and on the second member for moving the second member radially outwardly in response to movement of the shift shaft to the first drive position, means on the second member and on the forward cage for rotating the forward cage relative to the propeller shaft in a second rotary direction opposite to the first rotary direction in response to radially outward movement of the second member, means on the shift shaft and on the third member for moving the third member radially outwardly in response to axial movement of the shift shaft to the neutral position, means on the third member and on the rearward cage for rotating the rearward cage relative to the propeller shaft in the second rotary direction in response to radial outward movement of the third member, means on the shift shaft and on the fourth member for moving the fourth member radially outwardly in response to axial movement of the shift shaft to the second drive position, means on the fourth member and on the rearward cage for rotating the rearward cage relative to the propeller shaft in the first rotary direction in response to radially outward movement of the fourth member, means connected to the shift shaft for axially displacing the shift shaft between said neutral position and the first and second drive positions in response to activity of an operator, a thrust bearing located between the rearwardly facing radial wall on the forward bevel gear and the forwardly radial wall on the propeller shaft, a thrust bearing located between the forwardly facing radial wall on the rearward bevel gear and the rearwardly facing radial wall on the propeller shaft, a thrust bearing between the forwardly facing radial wall on the forward bevel gear and the gearcase, and a thrust bearing between the rearwardly facing radial wall on the rearward bevel gear and the gearcase.

The invention also provides a marine propulsion device including a propulsion unit comprising a gearcase including therein a cavity, a forwardly located bevel gear rotatably supported in the gearcase cavity for rotation and including a central bore, a rearwardly located bevel gear rotatably supported in the gearcase cavity for rotation, located in axial spaced and facing relation to the forwardly located bevel gear, and including a central bore, a propeller shaft extending in the cavity and including a forward portion extending in the bore of the forwardly located bevel gear and having an outer surface with a first diameter, a central portion having an outer surface with a second diameter greater than the first diameter, and a rearward portion extending through the bore in the rearwardly located bevel gear and having an outer surface with a third diameter less than the second diameter, a drive pinion supported for rotation and drivingly engaging both the first and second bevel gears, whereby the first and second bevel gears counter-rotate, means for transmitting forward propeller shaft thrust from the central portion of the propeller shaft to the forwardly located bevel gear and from the forwardly located bevel gear to the gearcase, and means for transmitting rearward propeller shaft thrust from the central portion of said propeller shaft to the rearwardly located bevel gear and from the rearwardly located bevel gear to the gear case.

The invention also provides a marine propulsion device including a propulsion unit comprising a gearcase including therein a cavity, a propeller shaft extending in the cavity and including a forward portion having an outer surface with a first diameter, a central portion having a second diameter greater than the first diameter, a forwardly facing radial wall extending between the forward portion and the central portion, a rearward portion having an outer surface with a third diameter less than the second diameter, and a rearwardly facing radial wall extending between the central portion and the rearward portion, a forwardly located bevel gear rotatably supported in the gearcase for rotation relative to the propeller shaft and including a central bore receiving the propeller shaft in spaced relation thereto, a forwardly facing radial wall, and a rearwardly facing radial wall, a rearwardly located bevel gear rotatably supported in the gearcase for rotation relative to the propeller shaft, located in axially spaced and facing relation to the forwardly located bevel gear and including a central bore receiving the propeller shaft in spaced relation thereto, a rearwardly facing radial wall, and a forwardly facing radial wall, a drive pinion supported for rotation by the propulsion unit and drivingly engaging both the first and second bevel gears, whereby the first and second bevel gears counter-rotate, a thrust bearing located between the rearwardly facing radial wall on the forward bevel gear and the forwardly facing radial wall on the propeller shaft, a thrust bearing located between the forwardly facing radial wall on the rearward bevel gear and the rearwardly facing radial wall on the propeller shaft, a thrust bearing between the forwardly facing radial wall on the forward bevel gear and the gearcase, and a thrust bearing between the rearwardly facing radial wall on the rearward bevel gear and the gearcase.

The invention also includes a propeller shaft including a forward portion having an outer surface with a first diameter and with an axially extending flat, a central portion having a second diameter greater than the first diameter, a forwardly facing radial wall extending between the forward portion and the central portion, a rearward portion having an outer surface with a third diameter less than the second diameter and with an axially extending flat, and a rearwardly facing radial wall extending between the central portion and the rearward portion.

Other features and advantages of the invention will become apparent to those skilled in the art upon review of the following detailed description, claims, and drawings.

THE DRAWINGS

Figure 1:
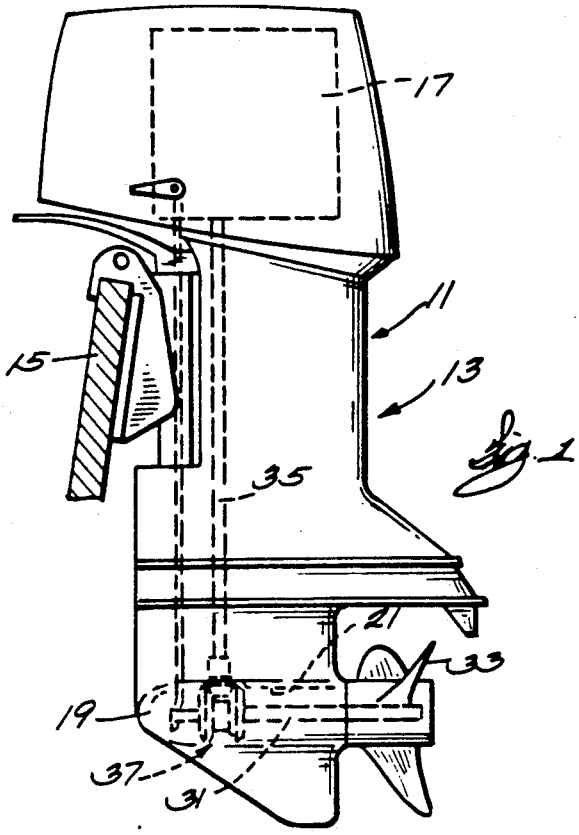
FIG. 1 is a side elevational view of a marine propulsion device embodying various of the features of the invention.

Before one embodiment of the invention is explained in detail, it is to be understood that the invention is not limited in its application to the details of the construction and the arrangements of compenents set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a marine propulsion device which is in the form of an outboard motor 11, but which can take other forms, as for instance, the form of a stern drive unit.

The outboard motor 11 includes a propulsion unit or assembly 13 which is adapted to be mounted on a boat hull 15 by any suitable means affording pivotal steering movement and pivotal tilting movement of the propulsion unit 13 relative to the boat hull 15 and which includes an engine 17 and a lower unit incorporating a gear case 19 having therein an interior cavity 21.

Rotatably extending in the gear case cavity is a propeller shaft 31 which, at its rearward end, is adapted to support a propeller 33 driven from the engine 17 by a drive train including a vertically extending drive shaft 35 rotatably supported by the propulsion unit 13 and a reversing transmission 37 supported in the gearcase cavity 21 and operable for selectively connecting the drive shaft 35 to the propeller shaft 31 in a neutral condition, a forward drive engagement, and a rearward drive engagement. While other construction can be employed, in the disclosed construction, the propeller shaft 31 includes a forward portion 41 having an outer surface 43 with a first diameter and with at least one axially extending flat 45, a central portion 47 having a second diameter greater than said first diameter, a forwardly facing radial wall 49 extending between the forward portion 41 and the central portion 47, a rearward portion 51 having an outer surface 53 with a third diameter less than said second diameter and with at least one axially extending flat 55, a rearwardly facing radial wall 57 extending between central portion 47 and the rearward portion 51, and a forwardly open axial bore 59.

The reversing transmission 37 includes a drive pinion 139 which is suitably fixed on the drive shaft 35 and which engages a first or forwardly located bevel gear 141 and a second or rearwardly located bevel gear 143 so as to counter rotate the bevel gears 141 and 143 when the drive pinion 139 is rotating.

The first or forwardly located bevel gear 141 is rotatably supported in the gearcase cavity 21 coaxially with the propeller shaft 31 by a suitable bearing 145 and includes a central smooth cylindrical bore 147 through which the forward portion 41 of the propeller shaft 31 extends, as well as a rearwardly facing radial wall 149 extending from the central bore 147 and engaging a thrust bearing 152 which, in turn, engages the forwardly facing radial wall 49 of the propeller shaft 31. The forwardly located bevel gear 141 also includes a forwardly facing radial wall 151 engaging a thrust bearing 153 engaged with a thrust washer 154, which, in turn, engages the gearcase 19, whereby forward propeller thrust is transmitted from the forwardly facing radial wall 49 of the propeller shaft 31 to the rearwardly facing radial wall 149 of the forwardly located bevel gear 141 and from the forwardly facing radial wall 151 of the forwardly located bevel gear 141 to the gearcase 19.

The second or rearwardly located bevel gear 143 is located in rearwardly spaced axial relation to the first bevel gear 141 and is suitable supported in the gearcase cavity 21 coaxially with the propeller shaft 31 by a suitable bearing 155 and includes a smooth cylindrical central bore 157 through which the rearward portion 51 of the propeller shaft 31 extends, as well as a forwardly facing radial wall 159 extending from the central bore 157 and engaging a thrust bearing 162 which, in turn, engages the rearwardly facing radial wall 57 of the propeller shaft 31. The rearwardly located bevel gear 143 also includes a rearwardly facing radial wall 161 engaging a thrust bearing 163 engaged with a thrust washer 165. In turn, the thrust washer 165 is engaged with a housing 166, which is secured, by suitable means not shown, to gearcase 19, within gearcase cavity 21, whereby rearward propeller thrust is transmitted from the rearwardly facing radial wall 57 of the propeller shaft 31 to the forwardly facing radial wall 159 of the rearwardly located bevel gear 43 and from the rearwardly facing radial wall 161 of the rearwardly located bevel gear 143 to the housing 166, and from the housing 166 to the gearcase 19.

The reversing transmission 37 also includes first or forwardly located roller clutch means 181 which is selectively engageable between the smooth cylindrical bore 147 of the first bevel gear 141 and the forward portion 41 of the propeller shaft 31 and rearwardly located roller clutch means 183 which is selectively engageable between the smooth cylindrical bore 157 of the second bevel gear 143 and the rearward portion 51 of the propeller shaft 31.

While various forwardly located roller clutch means can be employed, in the disclosed construction, such means comprises formation of the forward portion 41 of the propeller shaft 31 with the before mentioned flat 45. Still more particularly, while other constructions can be employed, in the disclosed construction, the forward propeller shaft portion 41 includes a series of nine axially extending flats 45 of equal size.

The forwardly located roller clutch means 181 also includes, in addition to the series of flats 45 on the forward portion 41 of the propeller shaft 31, a plurality of rollers 191 equal in number to the member of flats 45.

While a single roller or a single plurality of axially extending rollers 45 could be employed, in the disclosed construction, each roller 191 includes a plurality of axially aligned roller segments 193. In the specifically disclosed construction each roller 191 includes four such segments 193.

The forwardly located roller clutch means 181 also includes a first or forwardly located cylindrical cage 201 which retains the plurality of rollers 191 for common rotary movement with the cage 201 and relative to the propeller shaft 31 between a first or driving position in which the rollers 191 are drivingly engaged between the smooth central bore 147 of the first bevel gear 141 and the forward portion 41 of the propeller shaft 31 and a second or non-driving position in which the rollers 191 are free of driving engagement between the first bevel gear 141 the forward portion 41 of the propeller shaft 31.

Means are provided for rotating the forwardly located cage 201 between the driving and non-driving positions. While other specific constructions can be employed, in the disclosed construction, such means comprises the forwardly open axial bore 59 which is located in the propeller shaft 31 and which receives a shift shaft 211 movable axially in opposite directions between a forwardly located drive position, a central neutral position, and a rearwardly located drive position by suitable means still to be described.

Figure 2:
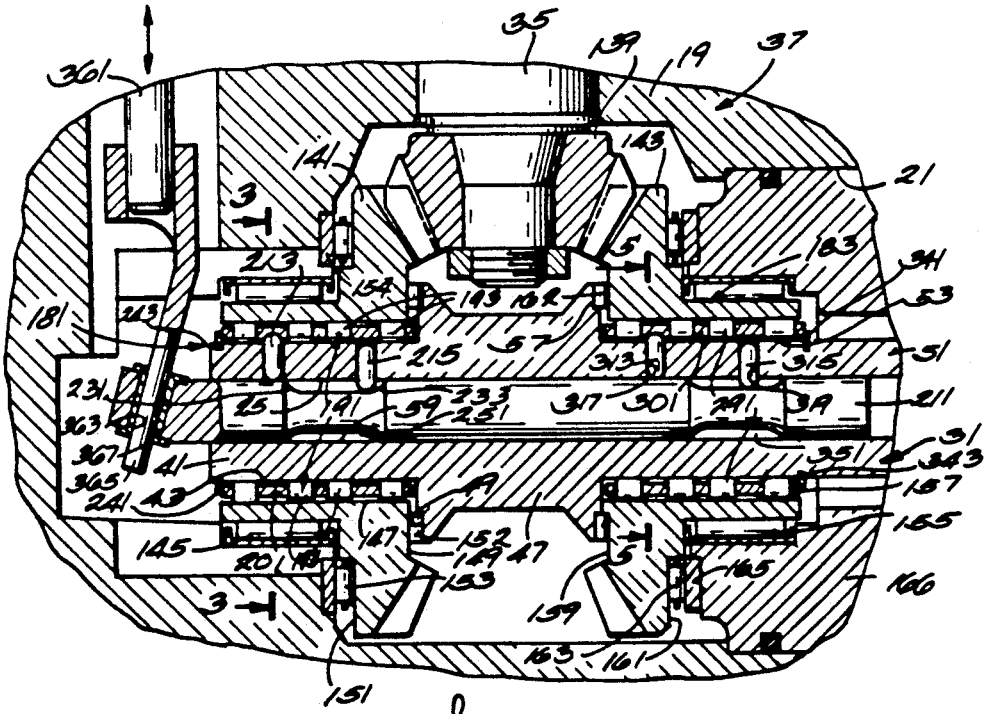
FIG. 2 is an enlarged view, partially in section, of a reversing transmission included in the marine propulsion device shown in FIG. 1.
Figure 3:
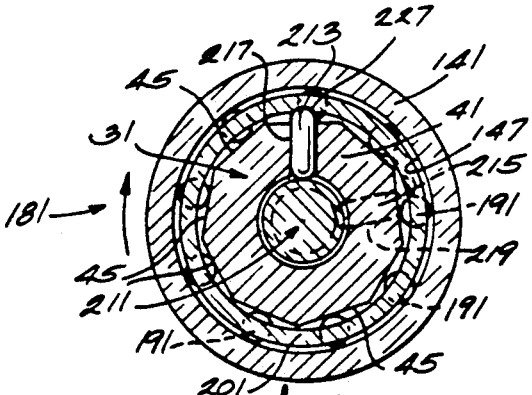
FIG. 3 is a sectional view taken along line 3—3 of FIG. 2 and illustrating various components of the reversing transmission in a drive position which is also shown in FIG. 7.
Figure 4:
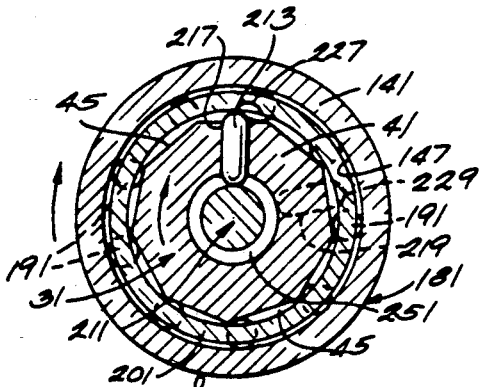
FIG. 4 is a view similar to FIG. 3 illustrating the same components in the condition when the reversing transmission is in the neutral and drive positions shown respectively in FIGS. 8 and 9.
Figure 6:
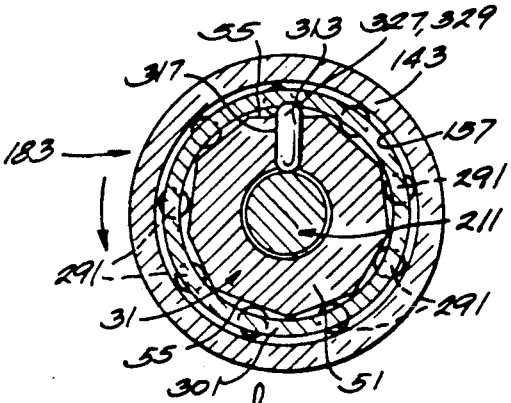
FIG. 6 is a view similar to FIG. 5 showing the same components in the condition when the reversing transmission is in the drive and neutral positions shown respectively in FIGS. 7 and 8.
Figure 5:
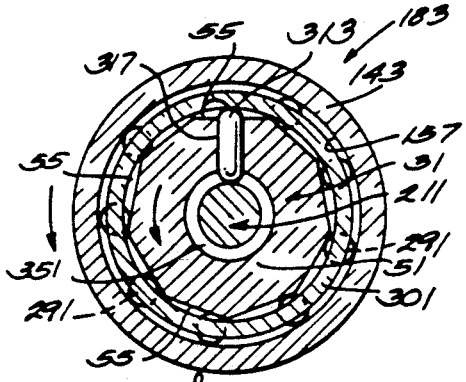
FIG. 5 is a sectional view taken along line 5—5 of FIG. 2 and illustrating the components of the reversing transmission in the condition which is shown in FIG. 7.

In addition, the means for rotating the forwardly located cage 201 between the driving and non-driving positions includes a first or drive pin member 213 and a second or neutral pin member 215 located in rearwardly spaced relation to the drive pin member 213, which drive pin members 213 and 215 are radially movable through respective holes or passages 217 and 219 in the forward portion 41 of the propeller shaft 31. The drive pin members 213 and 215 can be axially spaced and radially aligned as shown in FIGS. 2 and 3 in full lines or can be axially spaced and angularly spaced as shown in dotted lines in FIGS. 2 and 3, or can be located in a common plane and angularly spaced. In addition, if desired, more than one drive pin member 213 and more than one neutral pin member 215 can be employed.

The cage rotating means also includes means on the drive and neutral pin members 213 and 215 and on the shift shaft 211 and on the forwardly located cage 201 for locating the cage 201 in the drive position in response to axial movement of the shift shaft in one direction, i.e., rearwardly from the neutral position, and for locating the cage 201 in the non-driving position in response to axial movement of the shift shaft 211 in the other axial direction, i.e., forwardly from the drive position.

The means for rotating the forwardly located cage 201 includes means on the forwardly located cage 201 and the first or drive pin member 213 for rotating the forwardly located cage 201 in one direction of rotation, i.e., toward the drive position in response to radially outwardly movement of the first or drive pin member 213 consequent to movement of the shift shaft 211 to the rearwardly located drive position, and means on the forwardly located cage 201 and on the second or neutral pin member 215 for rotating the cage in the opposite rotary direction in response to radially outwardly movement of the second or neutral pin member 213 consequent to forward movement of the shift shaft 211 to the neutral position.

While other constructions can be employed, in the disclosed construction, such cage rotating means comprises formation of the radially outer ends of the first and second pin members 213 and 215 with a hemispherical shape and formation of the cage with first and second cam recesses 227 and 229 located for respective engagement with the first and second pins members 213 and 215 in response to outward radial movement thereof for effecting respective opposite rotary motion of the forwardly located cage 201 in response to radially outward movement of the first and second pin members 213 and 215.

The means for radially outwardly displacing or locating the first and second pin members 213 and 215 also includes means on the shift shaft 211 and on the first and second pin members 213 and 215 for radially outwardly displacing the pin members 213 and 215 and for permitting radially inward movement thereof in response to axial movement of the shift shaft 211 between the central neutral position and the rearwardly located drive position.

More particularly, while other constructions can be employed, in the disclosed construction, such means comprises formation of the radially inner ends of the first and second pin members 213 and 215 with a hemispheric shape and formation of the shift shaft 211 with a cooperating axially extending annular groove 251 located between adjacent portions of the outer surface of the shift shaft and including outwardly concave quarter round corners 231 and 233.

While other constructions can be employed, in the disclosed construction, the groove 251 has an axial length slightly larger than the axial spacing of the first and second pin members 213 and 215.

While the disclosed construction employs only a single drive pin member 213 and a single neutral pin member 215, if desired, more than one such pin members can be employed, which additional pin members can be angularly spaced from the illustrated pin members 213 and 215. Of course, each additional pin member would cooperate with a suitable camming recess on the cage and with the groove 251 on the shift shaft 211.

Means are provided for preventing axial movement of the forwardly located cage 201. While other constructions can be employed, in the disclosed construction, a C-ring 241 is engaged in a groove 243 in the propeller shaft 31 in a position adjacently forwardly of the forwardly located cage 201. The C-ring 241 and the forwardly facing radially extending wall 49 between the propeller shaft central portion 47 and the reduced diameter forward portion 41 prevent axial movement of the forwardly located cage 201.

The second or rearwardly located roller clutch means 183 is constructed generally identically to the first or forwardly located roller clutch means 181 except that a second or rearwardly located cylindrical cage 301 rotates in the opposite direction from the forwardly located cage 201 to the drive position from the non-driving position.

In other respects similar components such as third or neutral and fourth or drive pin members 313 and 315 are respectively axially displacable in holes or passages 317 and 319 in the propeller shaft 31 for respective engagement with cam recesses 327 and 329 in the rearwardly located cage 301. The pin members 313 and 315 are radially outwardly displacable by a groove 351 in the shift shaft 211 in response to shift shaft axial movement. In addition, axial movement of the rearwardly located cage 301 is prevented by a C-ring 341 located in a groove 343 in the rearward portion of the propeller shaft 31.

As already indicated, the grooves 251 and 351 permit inward movement of the pin members 213,215,313, and 315 from the radially outer positions to their radially inner positions in response to axial movement of the shift shaft 211 and the groove corners and outer surface portions of the shift shaft 211 adjacent to the grooves serve, in response to axial shift shaft movement, to radially outwardly displace and retain in outward disposition the pin members 213, 215,313, and 315.

Figure 8:
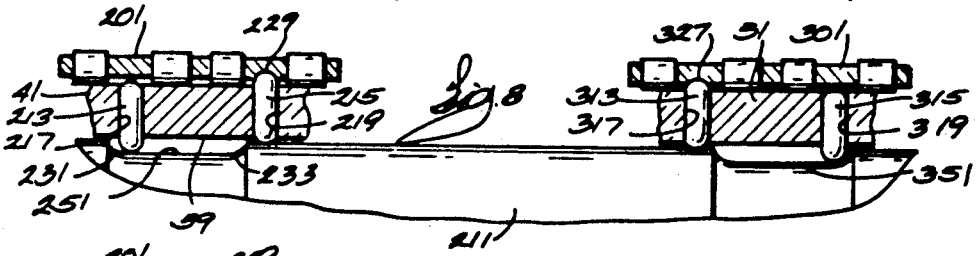
FIG. 8 is a view similar to FIG. 7 showing the condition of the components when the reversing transmission is in the neutral condition.

The reversing transmission 37 also includes means for coordinating the action of the forwardly and rearwardly located roller clutch means 181 and 183. In this regard, the third pin member 313 is forwardly located relative to the fourth pin member 315 and constitutes a neutral pin and the fourth pin member 315 constitutes a drive pin. In addition, the rearwardly located groove 351 is spaced from the forwardly located groove 251 at a distance such that when the shifter shaft 211 is in the neutral position, as shown in FIG. 8, the neutral pins 215 and 313 are engaged, at their inner ends, by the outer surface of the shift shaft 211, and, at their outer ends, are engaged in the cam recesses 229 and 327 to retain the cages 201 and 301 in the neutral or non-driving positions. At the same time, the drive pin members 213 and 315 are respectively located with their inner ends in the grooves 251 and 351.

In response to forward axial movement of the shift shaft 211 to the forwardly located drive position (shown in FIG. 9) from the neutral position (shown in FIG. 8), the grooves 251 and 351 and the adjacent outer surface portions on the shift shaft 211 effect movement of the rearwardly located pin member 315 radially outwardly to rotate the rearwardly located cage 301 to the drive position, as well as permit movement of the rearwardly located neutral pin 313 radially inwardly into the groove 351, thereby disengaging from the cam recess 327, and retention of the engagement of the forwardly located neutral pin 215 with the cam recess 229 in the forwardly located cage 201, thereby retaining the forwardly located roller clutch means 181 in neutral.

In response to rearward axial movement of the shift shaft 211 to the rearwardly located drive position (shown in FIG. 7) from the neutral position (shown in FIG. 8), the grooves 251 and 351 on the adjacent outer surface portions on the shift shaft 211 also effect movement of the forwardly located drive pin member 213 radially outwardly to rotate the forwardly located cage 201 to the drive position, as well as permit movement of the forwardly located neutral pin 215 radially inwardly into the groove 251, thereby disengaging from the cam recess 229, and retention of engagement of the rearwardly located neutral pin 313 with the cam recess 327 in the rearwardly located cage 301, thereby retaining the rearwardly located roller clutch means 183 in neutral.

Figure 7:
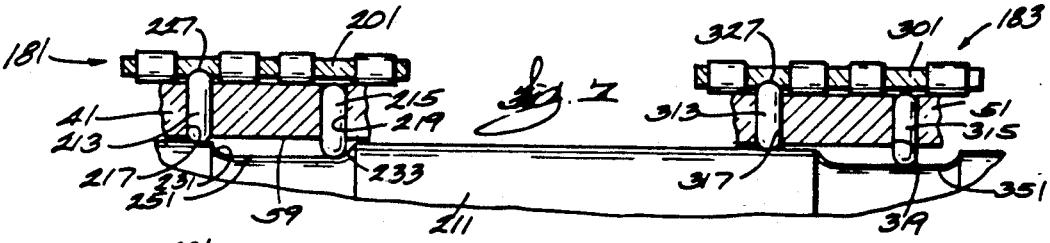
FIG. 7 is an enlarged view schematically showing the condition of the components when the reversing transmission is in one drive engagement.
Figure 9:
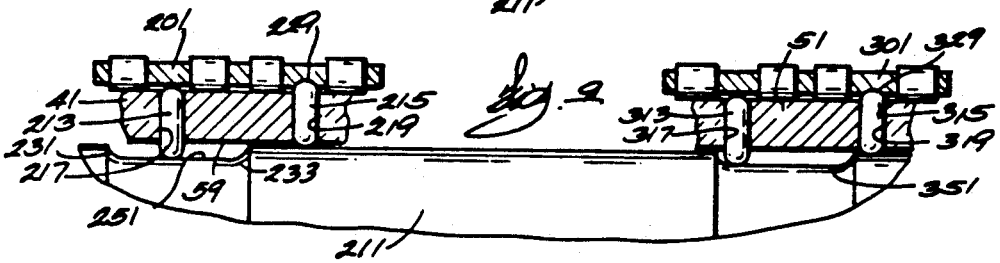
FIG. 9 is a view similar to FIGS. 7 and 8 showing the condition of the components when the reversing transmission is in another drive engagement.

Means are also provided for axially displacing the shift shaft relative to the neutral position shown in FIG. 8, to a rearwardly located drive position shown in FIG. 7 (which drive position engages the forwardly located clutch means 181) and to a forwardly located drive position shown in FIG. 9 (which drive position engages the rearwardly located clutch means 183).

While other constructions can be employed, in the illustrated construction, such means comprises a shift rod 361 which is suitably supported in the lower unit for vertical movement relative thereto and which is adapted to be vertically displaced in response to operator activity. In addition, the means for axially displacing the shift shaft 211 includes means connecting the shift shaft 211 and the shift rod 361 to effect forward shift shaft movement in response to upward movement of the shift rod 361 and rearward shift shaft movement in response to downward movement of the shift rod 361.

More particularly, in the particularly disclosed construction, the forward end of the shift shaft 211 includes an inclined opening 363 which slideably receives a tongue 365 extending fixedly from the shift rod 361. A bearing 367 can be interposed between the tongue 365 and the forward end of the shift shaft 211 to facilitate such sliding movement. As a result of the illustrated construction, the shift shaft 211 is not rotatable with the propeller shaft 31. However, if desired, the shift rod 361 can be connected to the shift shaft 211 to effect axial movement thereof in response to vertical shift rod movement while, at the same time, affording rotation of the shift shaft 211 with the propeller 31.

In addition, the shift rod 361 and the shift shaft can be connected so as to effect forward shift shaft movement in response to downward movement of the shift rod 361 and rearward shift shaft movement in response to upward movement of the shift rod 361. Thus, the disclosed construction may be arranged to provide either standard rotation or counter-rotation of the propeller shaft 31 in response to rotation of the drive shaft 35 in one rotative direction.

The disclosed roller clutch engages almost immediately, there is no impact, virtually no slippage, and no heat generation in the rollers, gears, or propeller shaft. The cages, actuating pin members, and shift shaft are not subjected to any impact loading and only experience loads well within the fatigue limits of the materials during shifting from idle. The speed with which shifting occurs has no adverse effect on any of the components, and the design will work on any size system.

Various of the features of the invention are set forth in the following claims.

I claim:

1. A marine propulsion device including a propulsion unit comprising a gearcase including therein a cavity, a propeller shaft extending in said cavity and including a portion having an outer surface with an axially extending flat, and a forwardly open axial bore, a bevel gear rotatably supported in said gearcase for rotation relative to said propeller shaft and including a central bore receiving said portion of said propeller shaft in spaced relation thereto, a drive pinion supported for rotation by said propulsion unit and drivingly engaging said bevel bear, a shift shaft located in said axial bore in said propeller shaft for axial movement relative to said propeller shaft and between a drive position and a neutral position, a roller retained between said flat and said bevel gear and movable between a driving position in driving engagement between said bevel gear and said propeller shaft and a non-driving position free of driving engagement between said bevel gear and said propeller shaft, and means operably connecting said shift shaft and said roller for displacing said roller to said driving position in response to movement of said shift shaft to said drive position and for displacing said roller to said non-driving position in response to movement of said shift shaft to said neutral position and including a member movable radially with respect to said propeller shaft.

2. A marine propulsion device in accordance with claim 1 wherein said means operably connecting said shift shaft and said roller includes a radially extending hole communicating with said bore and with said outer surface of said portion, a cage located intermediate said bevel gear and said portion of said propeller shaft and rotatable relative to said propeller shaft between a driving position and a non-driving position and retaining said roller for common movement therewith, wherein said radially movable member is located in said hole, and wherein said means operably connecting said shift shaft and said roller further includes means on said shift shaft and on said radially movable member for moving said radially movable member radially outwardly in response to axial movement of said shift shaft to said neutral position, and means on said radially movable member and on said cage for rotating said cage relative to said propeller shaft in one rotary direction in response to radial outward movement of said radially movable member.

3. A marine propulsion device in accordance with claim 2 wherein said means operably connecting said shift shaft and said roller further includes a second radially extending hole communicating with said bore and with said outer surface of said portion and located in spaced relation to said first hole, a second member located in said second hole for radial movement relative to said propeller shaft, means on said shift shaft and on said second member for moving said second member radially outwardly in response to movement of said shift shaft to said drive position, and means on said second member and on said cage for rotating said cage relative to said propeller shaft in a second rotary direction opposite to said one rotary direction in response to radially outward movement of said second member.

4. A marine propulsion device including a propulsion unit comprising a gearcase including therein a cavity, a propeller shaft extending in said cavity and including a forwardly open axial bore, and a portion having an outer surface with an axially extending flat, a first radially extending hole communicating with said bore and with said outer surface of said portion of said propeller shaft, a second radially extending hole communicating with said bore and with said outer surface of said portion of said propeller shaft and located in spaced relation to said first hole, a bevel gear rotatably supported in said gearcase for rotation relative to said propeller shaft and including a central bore receiving said portion of said propeller shaft in spaced relation thereto, a drive pinion supported for rotation by said propulsion unit and drivingly engaging said bevel gear, a cage located intermediate said bevel gear and said portion of said propeller shaft and rotatable relative to said propeller shaft between a drive position and a neutral portion, a roller retained by said cage for common movement therewith and located between said bevel gear and said flat on said portion of said propeller shaft for driving engagement therebetween when said cage is in said drive position and for non-driving relation thereto when said cage is in said neutral position, a first member located in said first hole for radial movement relative to said propeller shaft, a second member located in said second hole for radial movement relative to said propeller shaft, a shift shaft located in said axial bore in said propeller shaft for axial movement relative to said propeller shaft and between a neutral position and a drive position, means on said shift shaft and on said first member for moving said first member radially outwardly in response to axial movement of said shift shaft to said neutral position, means on said first member and on said cage for rotating said cage relative to said propeller shaft in a first rotary direction in response to radial outward movement of said first member, means on said shift shaft and on said second member for moving said second member radially outwardly in response to movement of said shift shaft to said drive position, means on said second member and on said cage for rotating said cage relative to said propeller shaft in a second rotary direction opposite to said first rotary direction in response to radially outward movement of said second member, and means connected to said shift shaft for axially displacing said shift shaft between said neutral position and said drive position in response to activity of an operator.

5. A marine propulsion device including a propulsion unit comprising a gearcase including therein a cavity, a propeller shaft extending in said cavity and including a forward portion having an outer surface with an axially extending flat, a rearward portion having an outer surface with a rearwardly extending flat, and a forwardly open axial bore, a forwardly located bevel gear rotatably supported in said gearcase for rotation relative to said propeller shaft and including a central bore receiving said forward portion of said propeller shaft in spaced relation thereto, a rearwardly located bevel gear rotatably supported in said gearcase for rotation relative to said propeller shaft, located in axially spaced and facing relation to said forwardly located bevel gear and including a central bore receiving said rearward portion of said propeller shaft in spaced relation thereto, a drive pinion supported for rotation by said propulsion unit and drivingly engaging both said first and second bevel gears, whereby said first and second bevel gears counter-rotate, a shift shaft located in said axial bore in said propeller shaft and movable axially therein relative to said propeller shaft and between a first drive position, a neutral position, and a second drive position, a forward roller retained between said flat on said forward portion of said propeller shaft and said forwardly located bevel gear and movable between a driving position in driving engagement between said forwardly located bevel gear and said forward portion of said propeller shaft and a non-driving position free of driving engagement between said forwardly located bevel gear and said forward portion of said propeller shaft, a rearward roller retained between said flat on said rearward portion of said propeller shaft and said rearwardly located bevel gear and movable between a driving position in driving engagement between said rearwardly located bevel gear and said rearward portion of said propeller shaft and a non-driving position free of driving engagement between said rearwardly located bevel gear and said rearward portion of said propeller shaft, means operably connecting said shift shaft and said forward and rearward rollers and including radially movable members for locating said forward roller and said rearward roller in said non-driving positions in response to movement of said shift shaft to said neutral position, for locating said forward roller in said driving position in response to movement of said shift shaft to said first drive position while retaining said rearward roller in said non-driving position, and for displacing said rearward roller to said driving position in response to movement of said shift shaft to said second drive position while retaining said forward roller in said non-driving position.

6. A marine propulsion device including a propulsion unit comprising a gearcase including therein a cavity, a propeller shaft extending in said cavity and including a forward portion having an outer surface with a first diameter and with an axially extending flat, a central portion having a second diameter greater than said first diameter, a forwardly facing radial wall extending between said forward portion and said central portion, a rearward portion having an outer surface with a third diameter less than said second diameter and with an axially extending flat, a rearwardly facing radial wall extending between said central portion and said rearward portion, a forwardly open axial bore, a first radially extending hole communicating with said bore and with said outer surface of said forward portion, a second radially extending hole communicating with said bore and with said outer surface of said forward portion and located in spaced relation to said first hole; a third radially extending hole communicating with said bore and with said outer surface of said rearward portion and located in spaced relation to said first and second holes, a fourth radially extending hole communicating with said bore and with said outer surface of said rearward portion and located in spaced relation to said first, second, and third holes, a forwardly located bevel gear rotatably supported in said gearcase for rotation relative to said propeller shaft and including a central bore receiving said propeller shaft in spaced relation thereto, a forwardly facing radial wall, and a rearwardly facing radial wall extending from said central bore, a rearwardly located bevel gear rotatably supported in said gearcase for rotation relative to said propeller shaft, located in axially spaced and facing relation to said forwardly located bevel gear and including a central bore receiving said propeller shaft in spaced relation thereto, a rearwardly facing radial wall, and a forwardly facing radial wall extending from said central bore, a drive pinion supported for rotation by said propulsion unit and drivingly engaging both said first and second gears, whereby said first and second bevel gears counter-rotate, a forward cage located intermediate said forwardly located bevel gear and said forward portion of said propeller shaft and rotatable relative to said propeller shaft between a drive position and a neutral portion, a forward roller retained by said forward cage for common movement therewith and located between said forwardly located bevel gear and said flat on said forward portion of said propeller shaft for driving engagement therebetween when said forward cage is in said drive position and for non-driving relation thereto when said forward cage is in said neutral position, a rearward cage located intermediate said rearward bevel gear and said rearward portion of said propeller shaft and rotatable relative to said propeller shaft between a drive position and a neutral position, a rearward roller retained by said rearward cage for common movement therewith and located between said rearwardly located bevel gear and said flat on said rearward portion of said propeller shaft for driving engagement therebetween when said rearward cage is in said drive position and for non-driving relation thereto when said rearward cage is in said neutral position, a first, member located in said first hole for radial movement relative to said propeller shaft, a second member located in said second hole for radial movement relative to said propeller shaft, a third member located in said third hole for radial movement relative to said propeller shaft, a fourth member located in said fourth hole for radial movement relative to said propeller shaft, a shift shaft located in said axial bore in said propeller shaft for axial movement relative to said propeller shaft and between a first drive position, a neutral position, and a second drive position, means on said shift shaft and on said first member for moving said first member radially outwardly in response to axial movement of said shift shaft to said neutral position, means on said first member and on said forward cage for rotating said forward cage relative to said propeller shaft in a first rotary direction in response to radial outward movement of said first member, means on said shift shaft and on said second member for moving said second member radially outwardly in response to movement of said shift shaft to said first drive position, means on said second member and on said forward cage for rotating said forward cage relative to said propeller shaft in a second rotary direction opposite to said first rotary direction in response to radially outward movement of said second member, means on said shift shaft and on said third member for moving said third member radially outwardly in response to axial movement of said shift shaft to said neutral position, means on said third member and on said rearward cage for rotating said rearward cage relative to said propeller shaft in said second rotary direction in response to radial outward movement of said third member, means on said shift shaft and on said fourth member for moving said fourth member radially outwardly in response to axial movement of said shift shaft to said second drive position, means on said fourth member and on said rearward cage for rotating said rearward cage relative to said propeller shaft in said first rotary direction in response to radially outward movement of said fourth member, means connected to said shift shaft for axially displacing said shift shaft between said neutral position and said first and second drive positions in response to activity of an operator, a thrust bearing located between said rearwardly facing radial wall on said forward bevel gear and said forwardly radial wall on said propeller shaft, a thrust bearing located between said forwardly facing radial wall on said rearward bevel gear and said rearwardly facing radial wall on said propeller shaft, a thrust bearing between said forwardly facing radial wall on said forward bevel gear and said gearcase, and a thrust bearing between said rearwardly facing radial wall on said rearward bevel gear and said gearcase.

7. A marine propulsion device including a propulsion unit comprising a gearcase including therein a cavity, a forwardly located bevel gear rotatably supported in said gearcase cavity for rotation and including a central bore, a rearwardly located bevel gear rotatably supported in said gearcase cavity for rotation, located in axial spaced and facing relation to said forwardly located bevel gear, and including a central bore, a propeller shaft extending in said cavity and including a forward portion extending in said bore of said forwardly located bevel gear and having an outer surface with a first diameter and with an axially extending flat, a central portion having an outer surface with a second diameter greater than said first diameter, and a rearward portion extending through said bore in said rearwardly located bevel gear and having an outer surface with a third diameter less than said second diameter and with an axially extending flat, a drive pinion supported for rotation and drivingly engaging both said first and second bevel gears, whereby said first and second bevel gears counter-rotate, means located rearwardly of said flat on said forward portion of said propeller shaft for transmitting forward propeller shaft thrust from said central portion of said propeller shaft to said forwardly located bevel gear, means for transmitting forward thrust from said forwardly located bevel gear to said gearcase, means located forwardly of said flat on said rearward portion of said propeller shaft for transmitting rearward propeller shaft thrust from said central portion of said propeller shaft to said rearwardly located bevel gear, and means for transmitting rearward thrust from said rearwardly located bevel gear to said gear case.

8. A marine propulsion device including a propulsion unit comprising a gearcase including therein a cavity, a propeller shaft extending in said cavity and including a forward portion having an outer surface with a first diameter, a central portion having a second diameter greater than said first diameter, a forwardly facing radial wall extending between said forward portion and said central portion, a rearward portion having an outer surface with a third diameter less than said second diameter, and a rearwardly facing radial wall extending between the central portion and said rearward portion, a forwardly located bevel gear rotatably supported in said gearcase for rotation relative to said propeller shaft and including a central bore receiving said propeller shaft in spaced relation thereto, a forwardly facing radial wall, and a rearwardly facing radial wall, a rearwardly located bevel gear rotatably supported in said gearcase for rotation relative to said propeller shaft, located in axially spaced and facing relation to said forwardly located bevel gear and including a central bore receiving said propeller shaft in spaced relation thereto, a rearwardly racing radial wall, and a forwardly facing radial wall, a drive pinion supported for rotation by said propulsion unit and drivingly engaging both said first and second bevel gears, whereby said first and second bevel gears counter-rotate, a thrust bearing located between said rearwardly facing radial wall on said forward bevel gear and said forwardly facing radial wall on said propeller shaft, a thrust bearing located between said forwardly facing radial wall on said rearward bevel gear and said rearwardly facing radial wall on said propeller shaft, a thrust bearing between said forwardly facing radial wall on said forward bevel gear and said gearcase, and a thrust bearing between said rearwardly facing radial wall on said rearward bevel gear and said gearcase.

9. A propeller shaft including a forwardly open axial bore, a forward portion having an outer surface with a first diameter and with an axially extending flat, a central portion having a second diameter greater than said first diameter, a forwardly facing radial wall extending between said forward portion and said central portion, a rearward portion having an outer surface with a third diameter less than said second diameter and with an axially extending flat, a rearwardly facing radial wall extending between said central portion and said rearward portion, a first radially extending hole communicating with said bore and with said outer surface of said forward portion, a second radially extending hole communicating with said bore and with said outer surface of said forward portion and located in spaced relation to said first hole, a third radially extending hole communicating with said bore and with said outer surface of said rearward portion and located in spaced relation to said first and second holes, and a fourth radially extending hole communicating with said bore and with said outer surface of said rearward portion and located in spaced relation to said first, second, and third holes.

10. A propeller shaft including a forwardly open axial bore, a forward portion having an outer surface with an axially extending flat, a rearward portion having an outer surface with an axially extending flat, a first radially extending hole communicating with said bore and with said outer surface of said forward portion, a second radially extending hole communicating with said bore and with said outer surface of said forward portion and located in spaced relation to said first hole, a third radially extending hole communicating with said bore and with said outer surface of said rearward portion and located in spaced relation to said first and second holes, and a fourth radially extending hole communicating with said bore and with said outer surface of said rearward portion and located in spaced relation to said first, second, and third holes.

11. A propeller shaft including a forwardly open axial bore, a portion having an outer surface with an axially extending flat, a first radially extending hole communicating with said bore and with said outer surface of said portion, and a second radially extending hole communicating with said bore and with said outer surface of said portion and located in axially spaced relation to said first hole.

12. A propeller shaft including a forwardly open axial bore, a forward portion having an outer surface with an axially extending flat, a rearward portion axially spaced from said forward portion and having an outer surface with an axially extending flat, a first radially extending hole communicating with said bore and with said outer surface of said forward portion, and another radially extending hole axially spaced from said first hole and communicating with said bore and with said outer surface of said rearward portion.

* * * * *